US005588903A

United States Patent [19]

Pennison

[11] Patent Number: 5,588,903

[45] Date of Patent: Dec. 31, 1996

[54] ERGONOMIC POWER TOOL

[75] Inventor: Robert A. Pennison, Bellville, Tex.

[73] Assignee: Indresco Inc., Dallas, Tex.

[21] Appl. No.: 287,543

[22] Filed: Aug. 8, 1994

[51] Int. Cl.[6] ..... B24B 23/00; B24B 27/08

[52] U.S. Cl. ..... 451/344; 451/358; 451/359; 173/169; 173/221

[58] Field of Search ..... 173/218, 219, 173/221, 168, 169; 451/294, 295, 344, 358, 359, 449

[56] References Cited

U.S. PATENT DOCUMENTS

| | | | |
|---|---|---|---|
| 3,116,617 | 1/1964 | Skoog | 64/26 |
| 3,299,781 | 1/1967 | Law | 173/169 |
| 3,373,824 | 3/1968 | Whitehouse | 173/12 |
| 3,472,081 | 10/1969 | Keller et al. | 74/48 |
| 3,556,230 | 1/1971 | Rogenburk | 172/93.5 |
| 3,586,115 | 6/1971 | Amtsberg | 173/163 |
| 3,610,343 | 10/1971 | Bratt | 173/12 |
| 3,696,871 | 10/1972 | Stenbacka | 173/12 |
| 3,739,659 | 6/1973 | Workman, Jr. | 74/751 |
| 3,809,179 | 5/1974 | Delaney, Jr. et al. | 181/36 A |
| 3,832,772 | 9/1974 | Sumida | 173/169 |
| 3,871,138 | 3/1975 | Welsch . | |
| 4,081,038 | 3/1978 | Andersson et al. | 173/162.1 |
| 4,120,604 | 10/1978 | Garofalo | 415/25 |
| 4,147,219 | 4/1979 | Wallace | 173/12 |
| 4,154,309 | 5/1979 | Sappington | 173/221 |
| 4,155,278 | 5/1979 | Estok | 81/57.11 |
| 4,258,799 | 3/1981 | Eckman | 173/169 |
| 4,266,444 | 5/1981 | Anderson et al. | 74/661 |
| 4,300,641 | 11/1981 | Kinkel | 173/12 |
| 4,307,784 | 12/1981 | Smith | 173/12 |
| 4,359,107 | 11/1982 | Smith | 173/12 |
| 4,421,181 | 12/1983 | Andersson et al. | 173/162.2 |
| 4,434,858 | 3/1984 | Whitehouse | 173/12 |
| 4,462,282 | 7/1984 | Biek | 81/57.11 |
| 4,476,942 | 10/1984 | Elkin | 173/169 |
| 4,484,871 | 11/1984 | Adman et al. | 418/69 |
| 4,522,269 | 11/1985 | Adman et al. | 173/12 |
| 4,553,948 | 11/1985 | Tatsuno | 464/25 |
| 4,766,787 | 8/1988 | Sugimoto et al. | 81/463 |
| 4,789,373 | 12/1988 | Adman | 464/25 |
| 4,836,296 | 6/1989 | Biek | 173/93.5 |
| 4,844,177 | 7/1989 | Robinson et al. | 173/12 |
| 4,869,139 | 9/1989 | Gotman | 81/475 |
| 4,880,064 | 11/1989 | Willoughby et al. | 173/12 |
| 4,972,733 | 11/1990 | Olmr et al. | 81/177.1 |
| 4,991,473 | 2/1991 | Gotman | 81/475 |
| 5,080,181 | 1/1992 | Tatsuno | 173/93.5 |
| 5,092,410 | 3/1992 | Wallace et al. | 173/93.5 |
| 5,181,575 | 1/1993 | Maruyama et al. | 173/180 |
| 5,203,242 | 4/1993 | Hansson | 81/469 |
| 5,269,045 | 12/1993 | DeSerio et al. | 16/114 |
| 5,273,120 | 12/1993 | Chang | 173/162.2 |
| 5,322,131 | 6/1994 | Pressley et al. | 173/162.1 |
| 5,407,381 | 4/1995 | Shaefer et al. | 451/358 |

FOREIGN PATENT DOCUMENTS

| | | | |
|---|---|---|---|
| 2156657 | 2/1993 | Germany | B25F 5/02 |
| 2261836 | 6/1993 | United Kingdom | B25F 5/02 |
| 9201535 | 2/1992 | WIPO | B25F 5/02 |

OTHER PUBLICATIONS

*Atlas Copco* 1987 Catalog, "Industrial Power Tools" (five pages).

"Cleco Air Tools" *Industrial Tool Division, Indresco,* Copyright 1993, covers and pp. G–8 and G–9.

"Introducing a Revolutionary Series of Grinders." *Ingersoll-Rand Professional Tools,* two pages.

European Search Report dated Oct. 31, 1995, European Patent Application No. 95 30 5528.

*Primary Examiner*—Timothy V. Eley

*Attorney, Agent, or Firm*—Baker & Botts, L.L.P.

[57] ABSTRACT

An ergonomic, hand-held power tool (10) is disclosed having a housing (12) formed to have a main body portion (14) having a cavity (32) and a handle portion (16) coupled to the main portion (14). The main body portion (14) has a first longitudinal axis (66). The handle portion (16) has a second longitudinal axis (68) formed to be at an acute angle (70) with respect to the first longitudinal axis (66). A flexible material (28) may be attached to the handle portion (16) or used to form an exterior coating on the housing (12) to help minimize any vibration transferred to the operator's hand.

8 Claims, 2 Drawing Sheets

ERGONOMIC POWER TOOL

TECHNICAL FIELD OF THE INVENTION

This invention relates to power tools, and more particularly, but without limitation, to ergonomic die grinders.

RELATED APPLICATION

This application is related to co-pending, co-assigned patent application Ser. No. 08/287,544, filed Aug. 08, 1994, and entitled "Air Tool with Exhaust Diverting Valve," which is incorporated herein for all purposes.

BACKGROUND OF THE INVENTION

Hand-held power tools are used for a number of purposes. One type of hand-held power tool is known as a die grinder. Die grinders are typically high speed power tools having a rotating attachment used for conventional grinding, cutting, or buffing of an element, such as where a tool is used to remove excess material, e.g., a weld bead, from a metal work piece.

In operating die grinders and other power tools, the operator must use caution to remain safe and healthy. One concern that must be addressed by the power tool operator, or his or her employer, is the prevention of disorders of the hands and arms when performing tasks consisting of highly repetitive motion and/or exposure to extended vibration. Cumulative trauma disorders such as carpal tunnel syndrome and tendinitis can be caused or aggravated by repetitious, forceful exertion of the hands and arms. Vibration may also contribute to a condition called Raynaud's Syndrome. These disorders may develop gradually over periods of weeks, months, and years. Although, it is not presently known to what extent exposure to vibrations or repetitive motions may contribute to these disorders, it might be advisable to minimize vibration and repetitive motions when possible.

In protecting a power tool operator, such as a die grinder operator, it may be necessary for the operator or employer to take steps to prevent disorders of the hands and arms mentioned above. The steps may include repositioning the work piece or redesigning the workstation, reassigning an operator to other jobs, rotating jobs, changing the work pace, and/or changing the type of tool used so as to minimize stress on the operator.

In operating conventional hand-held die grinders, the operator places a portion of the die grinder into the palm of the operator's hand, and depresses a throttle mechanism. The throttle causes an element to rotate, such as a grinding element, which may then be placed into contact with the work piece. This type of conventional die grinder, such as that shown in U.S. Pat. No. 3,809,179, to Delaney, Jr. et al., has a single longitudinal axis. In grabbing the straight die grinder, it is common for the operator to bend his or her wrist in ulnar deviation to avoid being exposed to the sparks, swarf, and grinding residue resulting from the application of the rotating element, such as an abrasive wheel or carbide burr, to the work piece. The operator may also grasp the tool and angle it to engage the work piece with the tool in an orientation that allows clear vision and allows a desired result to be obtained. Continued operation in ulnar deviation of the wrist is generally not recommended.

SUMMARY OF THE INVENTION

A need has arisen for a hand-held power tool configured to minimize ulnar deviation of the operator's wrist during use and to minimize vibration experienced by the operator. In accordance with the present invention, a power tool is provided that substantially eliminates or reduces disadvantages and problems associated with previously developed power tools, such as conventional die grinders.

According to one aspect of the present invention, an ergonomic hand-held power tool is provided with a housing having a cavity and formed with a main body portion having a first longitudinal axis and a handle portion attached to the main portion having a second longitudinal axis. The power tool may include a drive assembly coupled to a motor for rotating the drive assembly to which an attachment may be releasably secured. The first longitudinal axis of the main body or rotating axis is preferably disposed at an angle with respect to the second longitudinal axis of the handle. According to another aspect of the present invention, a flexible material may be used to form the handle or attached to the handle to minimize any vibration transferred to the operator's hand from the power tool.

Technical advantages of the present invention include allowing an operator to use a power tool, such as a die grinder, to apply the power tool to the work piece without substantial ulnar deviation of the operator's wrist. Another technical advantage of the present invention, includes minimizing any vibrational energy transferred to the operator's hand or wrist.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF THE INVENTION

Figure 1:
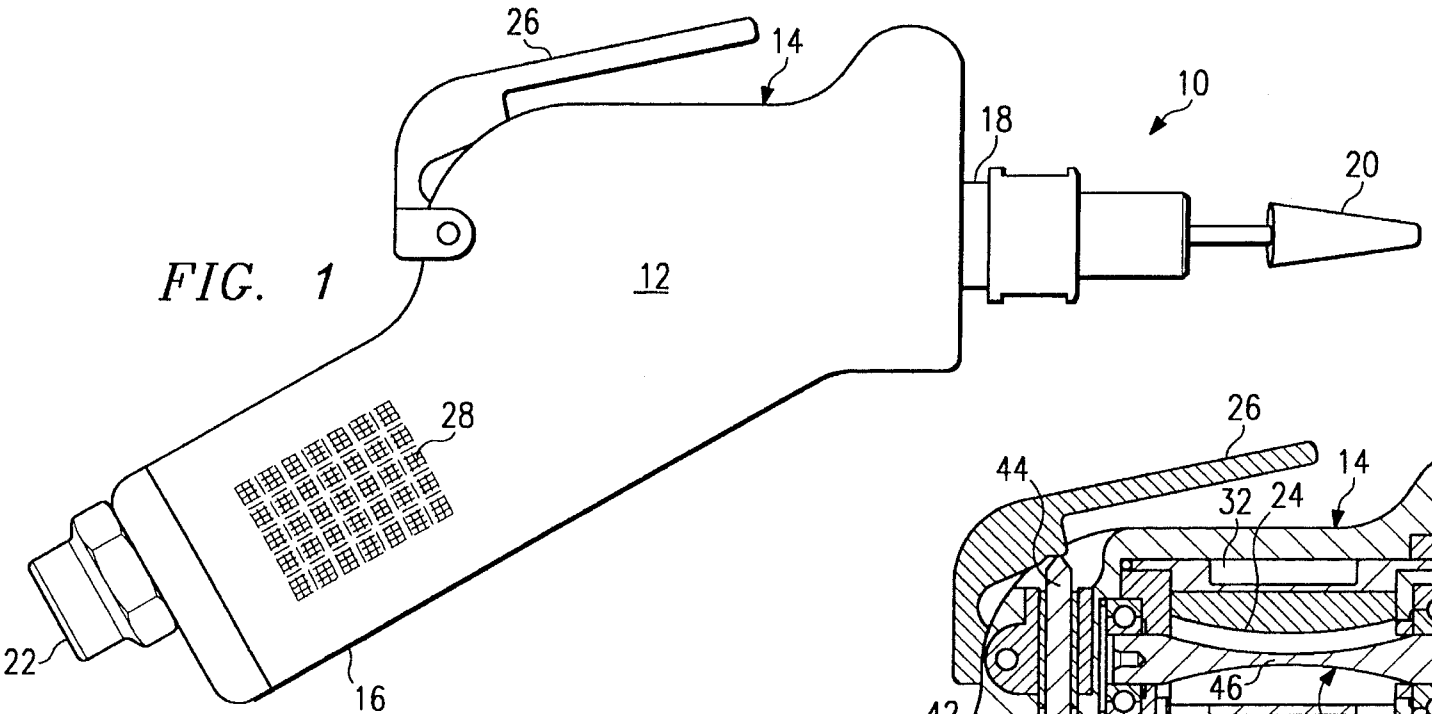
FIG. 1 is an elevational view of a power tool according to one aspect of the present invention.
Figure 2:
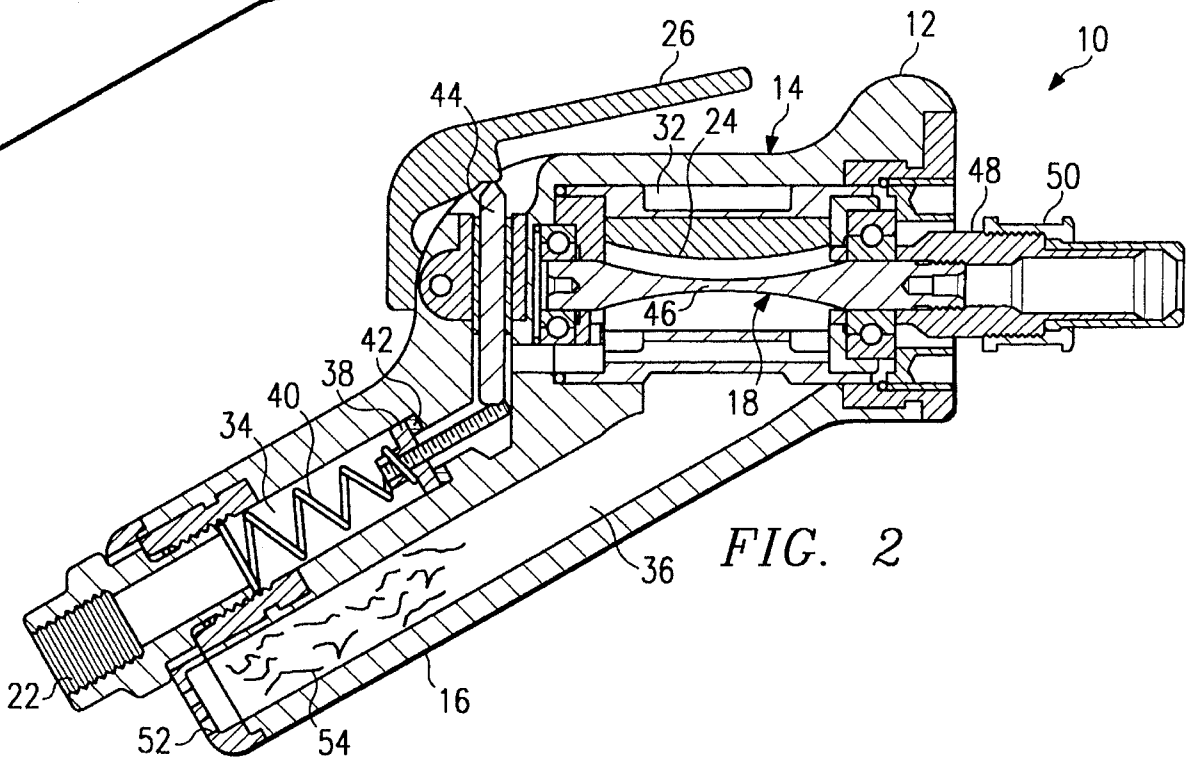
FIG. 2 is a drawing in section with portions broken away of a power tool according to one aspect of the present invention.
Figure 3:
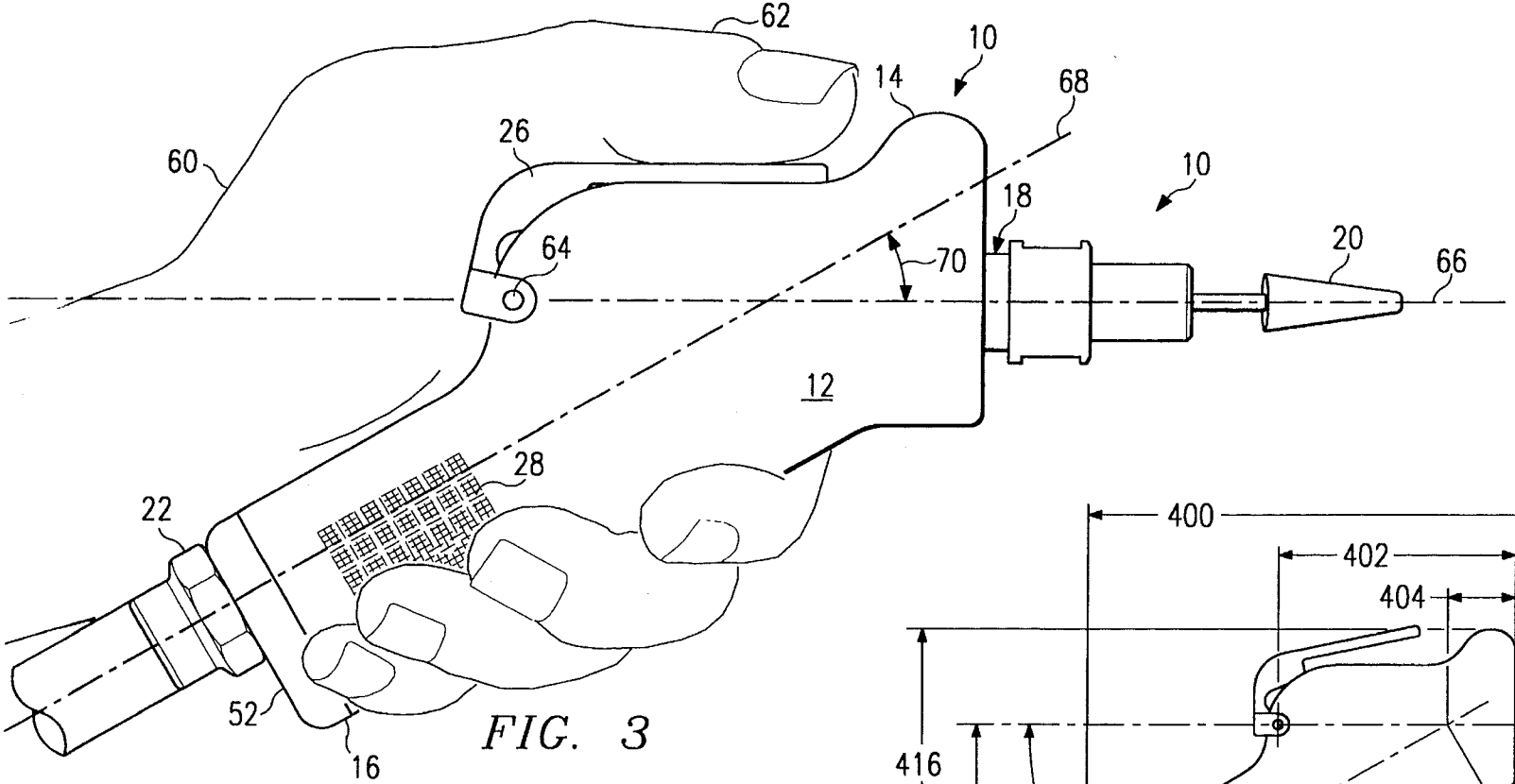
FIG. 3 is a schematic view of a power tool according to an aspect of the present invention being gripped in an operator's hand.

The preferred embodiments of the present invention and its advantages are best understood by referring to FIGS. 1 through 3 of the drawings, like numerals being used for like and corresponding parts of the various drawings.

The present invention has application to numerous types of hand-held power tools, but is presented in the context of a hand-held die grinder tool for purposes of illustration. Referring to FIG. 1, there is shown a hand-held die grinder 10 according to an aspect of the present invention. Die grinder 10 has a housing 12 having a main body portion 14 and a handle portion 16. Forming housing 12 from the main portions 14 and handle portion 16 allows varying the dimensions of each portion as required to accommodate air motor 24 (FIG. 2) and to allow tool 10 to fit within the operator's hand. Housing 12 may be sized to fill the hand of the average operator to allow the operator to grasp the tool 10 in what is known in human factors as a power grip, rather than a modified pinch grip. A portion of a drive assembly 18 emerges from main body portion 14 of housing 12. A tool element, or grinding element, such as a deburring element 20, may be coupled to drive assembly 18.

Die grinder 10 is shown as a pneumatic power tool having an air supply inlet 22, which powers an air motor 24 (FIG. 2). Air motor 24 is preferably coupled to drive assembly 18 and rotates grinding element 20. A throttle lever 26 may be used to control the speed of motor 24 by regulating air flow from inlet 22 to air motor 24. A portion of the operator's hand, typically the operator's thumb, may be used to depress lever 26. A hand grip material or flexible material 28 may be secured on handle portion 16 or formed integral with handle portion 16. Flexible material 28 may be a polymer material that helps to isolate vibrational energy from the operator's hand.

Referring now to FIG. 2, hand-held die grinder 10 is shown with portions broken away and with grinding element 20 removed. As shown in FIG. 2, housing 12 is formed with a cavity 32 therein. Air motor 24 may be attached within cavity 32. Other cavities or channels may be formed in housing 12; for example, an air supply channel 34 and an air exhaust channel 36 are formed therein.

Compressed air or other suitable pneumatic fluid may be supplied to air supply inlet 22 from a remote source (not shown). Supply inlet 22 is formed on one end of air supply channel 34. A throttle valve 38 is preferably disposed in air supply channel 34. Throttle valve 38 is biased by spring 40 away from air supply inlet 22 and towards valve seat 42. Throttle lever 26 is associated with throttle valve 38 through linkage 44 such that proportional movement of lever 26 causes proportional unseating of throttle valve 38 from seat 42 which allows pressurized air to flow through air supply channel 34 and be delivered to motor 24. Motor 24 rotates under the influence of the pressurized air. Motor 24 is coupled to drive assembly 18. Drive assembly 18 may include a rotor 46, chuck 48, and chuck guard 50 as well as other components known in the art.

Air exhausted from motor 24 is directed to exhaust channel 36 and through exhaust outlet 52. A muffler material 54 may be placed in exhaust channel 36 to lower noise levels associated with the airflow therethrough. Other exhaust configurations may be used or mufflers; for example, the muffler shown in U.S. Pat. No. 3,809,179, which is incorporated herein for all purposes, may be used.

Referring now to FIG. 3, there is shown a schematic of die grinder 10 in an operator's hand 60. The operator's hand 60 is shown in a position that allows the operator to hold die grinder 10 without requiring ulnar deviation. The operator's thumb 62 is shown depressing throttle lever 26 causing it to rotate about pivot 64. The operator has die grinder 10 in the palm of his or her hand, with the operator's fingers secured about the handle portion 16 of housing 12. Main body portion 14 of housing 12 preferably includes a first longitudinal axis 66, which is shown to coincide with the axis of rotation of drive assembly 18. Handle portion 16 of housing 12 preferably includes a second longitudinal axis 68. First longitudinal axis 66 and second longitudinal axis 68 are preferably formed with an acute angle 70 therebetween. Acute angle 70 is configured to allow the operator to hold tool 10 in the palm of his or her hand and yet apply grinding element 20 without requiring ulnar deviation.

For one embodiment, acute angle 70 is approximately thirty degrees. Angling second longitudinal axis 68 of handle portion 16 with respect to the axis of rotation 66 of drive assembly 18 allows the operator to use tool 10 while minimizing the possibility of injury as compared to previously known tools. Angle 70 allows positioning of grinding element 20 for good visibility by the operator without requiring the operator to bend his or her wrists in ulnar deviation. Additionally, housing 12 may be coated with a flexible material 28, or a flexible material 28 may be attached to handle 16, to help isolate vibrational energy from being transmitted from tool 10 to the operator's hand.

Figure 4:
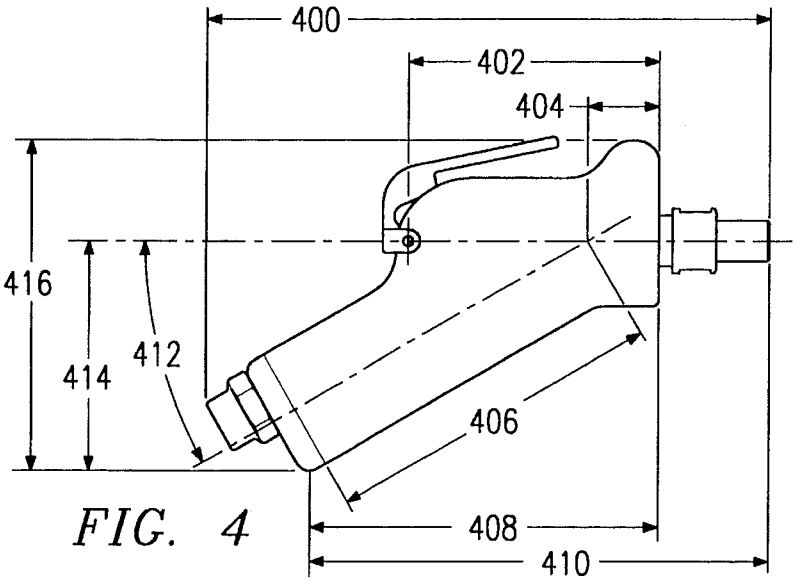
FIG. 4 is an elevational view of a power tool according to one aspect of the present invention referencing one set of possible dimensions.

Referring now to FIG. 4, there is shown one set of possible dimensions for tool 10. The dimensions are as follows:

| Reference Numeral | Dimension |
|---|---|
| 400 | 6 9/16" |
| 402 | 2 7/8" |
| 404 | 15/16" |
| 406 | 3 3/4" |
| 408 | 4 1/8" |
| 410 | 5 3/8" |
| 412 | 30° |
| 414 | 2 11/16" |
| 416 | 3 13/16" |

Of course, other dimensions are possible for tool 10.

Although the present invention and its advantages have been described in detail, it should be understood that various changes, substitutions and alterations can be made therein without departing from the spirit and scope of the invention as defined by the appended claims.

What is claimed is:

1. An ergonomic hand-held air powered tool comprising:

a motor;

a drive assembly coupled to the motor and having a first longitudinal axis;

a housing comprising:

a main body portion forming a cavity and having the motor secured in the cavity, and a handle portion attached to the main portion and having a second longitudinal axis;

a chuck coupled to the drive assembly for releasably securing a tool element to the drive assembly;

a throttle associated with the motor for selectively controlling the speed of the motor, the throttle comprising:

a throttle valve comprising:

a biasing spring having a first end abutting a portion of the housing;

a valve seat;

a valve flange abutting a second end of the biasing spring for urging the valve flange towards the valve seat; and linkage connected to a portion of the valve flange for causing the valve flange to unseat from the valve seat when depressed;

a throttle lever coupled to the throttle valve;

a pivot pin secured to one end of the throttle lever coupled to the throttle valve; and the first longitudinal axis of the main body forming an angle less than 60 degrees and more than zero degrees with respect to the second longitudinal axis of the handle.

2. The tool of claim 1 further comprising a flexible material secured to an exterior surface of the handle portion.

3. The tool of claim 2 wherein the flexible material comprises a plastic material.

4. The tool of claim 1 wherein the first longitudinal axis and the second longitudinal axis form an acute angle of approximately thirty degrees.

5. The tool of claim 1 wherein in the first longitudinal axis is aligned with the pivot pin allowing the throttle lever to be positioned substantially parallel to the first longitudinal axis.

6. The hand-held power tool of claim 1 further comprising a throttle lever on a top side of the main body portion for controlling the speed of the motor.

7. The hand-held power tool of claim 1 wherein the power tool comprises a pneumatic powered hand-held tool.

8. The hand-held power tool of claim 1 wherein the motor comprises an air motor.

* * * * *